US011175109B1

(12) United States Patent
Lee et al.

(10) Patent No.: US 11,175,109 B1
(45) Date of Patent: Nov. 16, 2021

(54) DUAL-FINGER OPERABLE SAFETY SELECTOR FOR FIREARMS

(71) Applicant: Strike Industries, Inc., Santa Ana, CA (US)

(72) Inventors: Shanyao Lee, Santa Ana, CA (US); Shih-Ting Hung, Taoyuan (TW)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 17/097,159

(22) Filed: Nov. 13, 2020

(51) Int. Cl.
*F41A 17/46* (2006.01)
*F41A 35/06* (2006.01)

(52) U.S. Cl.
CPC ..... *F41A 17/46* (2013.01); *F41A 35/06* (2013.01)

(58) Field of Classification Search
CPC ..... F41A 35/06; F41A 17/46; F41A 17/52
USPC ..... 89/148; 42/70.06
See application file for complete search history.

(56) References Cited

U.S. PATENT DOCUMENTS

2012/0325044 A1* 12/2012 Brown ..... F41A 19/33 74/548

* cited by examiner

*Primary Examiner* — Reginald S Tillman, Jr.
(74) *Attorney, Agent, or Firm* — Han IP PLLC; Andy M. Han

(57) ABSTRACT

A device implementable on a firearm includes an ambidextrous safety selector switch. The ambidextrous safety selector switch is configured to be installed on a receiver portion of the firearm and operable by a first finger of a hand of a user on a first side of the receiver portion and by a second finger of the hand of the user on a second side of the receiver portion opposite the first side thereof when installed on the receiver portion.

14 Claims, 5 Drawing Sheets

DUAL-FINGER OPERABLE SAFETY SELECTOR FOR FIREARMS

TECHNICAL FIELD

The present disclosure is generally related to firearms and, more particularly, to a dual-finger operable safety selector for firearms.

BACKGROUND

Unless otherwise indicated herein, approaches described in this section are not prior art to the claims listed below and are not admitted as prior art by inclusion in this section.

On certain types of firearms (e.g., firearms based on an AR platform such as AR15-styled or AR10-styled rifles, carbines, pistols and shotguns), a safety selector (also known as "safety selector switch" or "selector switch") is a device that allows a user of the firearm to select a mode in which the firearm is placed. On a semi-automatic firearm, for example, selectable modes typically include a "safe" mode, in which the trigger of the firearm is prevented from being pulled to prevent firing or discharge of any round of ammunition cartridge, and a "fire" mode, in which the trigger can be pulled (and to cause a round of ammunition cartridge in the chamber, if any, to go off). On a full-automatic firearm, in addition to the "safe" mode, other selectable modes may include, for example, a "burst" mode, in which multiple rounds may be fired in a burst fashion with a single pull of the trigger, and a "full-auto" mode, in which continuous rounds may be fired so long as the trigger is pulled and held in the pulled position by the user.

Conventional safety selectors tend to be designed to be operated by one and the same finger of the user, e.g., the thumb. For instance, when the user intends to use (e.g., fire) the firearm, the user would use his/her thumb to turn the safety selector from a first position for the "safe" mode to a second position for the "fire" mode. Moreover, when the user is done using the firearm, the user would use his/her thumb to turn the safety selector from the second position back to the first position to place the firearm in the "safe" mode. However, there may be times during which it may be more convenient for the user to use a different finger to turn the safety selector from one position to another.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issues, an objective of the present disclosure is to propose an innovative design of a dual-finger operable safety selector for firearms. It is believed that, compared to conventional designs, a dual-finger operable safety selector under various proposed designs in accordance with the present disclosure would provide greater flexibility or convenience for a user in operating a firearm.

In one aspect, a device implementable on a firearm (e.g., a firearm based on an AR platform such as an AR15-styled or AR10-styled rifle, carbine, pistol or shotgun) may include an ambidextrous safety selector switch. The ambidextrous safety selector switch may be configured to be installed on a receiver portion of the firearm and operable by a first finger of a hand of a user on a first side of the receiver portion and by a second finger of the hand of the user on a second side of the receiver portion opposite the first side thereof when installed on the receiver portion.

In another aspect, a device implementable on a firearm (e.g., a firearm based on an AR platform such as an AR15-styled or AR10-styled rifle, carbine, pistol or shotgun) may include a first safety selector configured to be installed on a receiver portion of the firearm. The first safety selector may include a first connection portion and a first lever portion. The first connection portion may be configured to pivotably couple to the receiver portion. The first lever portion may have a first distal end and a second distal end extending away from the first connection portion in two different directions. Accordingly, when installed on the receiver portion of the firearm: (1) the first safety selector may be pivotable clockwise responsive to a user pressing or pushing either of the first distal end and the second distal end in one way, and (2) the first safety selector may be pivotable counter-clockwise responsive to the user pressing or pushing either of the first distal end and the second distal end in another way.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
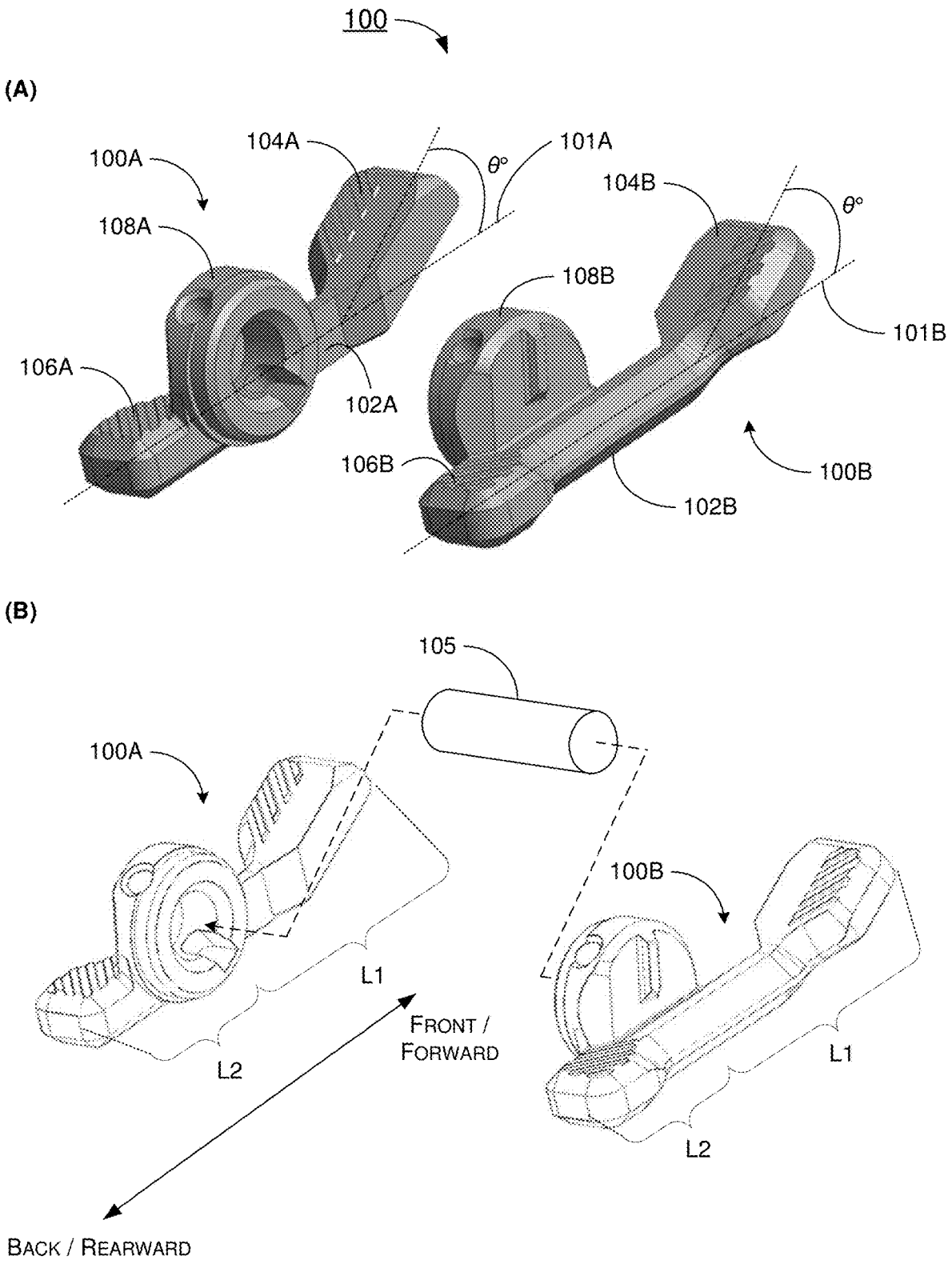
FIG. 1 is a diagram of a device in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

FIG. 1 illustrates a device 100 in accordance with an implementation of the present disclosure. Each of FIG. 2~FIG. 5 respectively illustrates an example scenario of an implementation of device 100 in accordance with an implementation of the present disclosure. Description of device 100 below is provide with reference to FIG. 1~FIG. 5.

Referring to FIG. 1, device 100 may include an ambidextrous safety selector switch. Referring to FIG. 2~FIG. 5, the ambidextrous safety selector switch may be configured to be installed on a receiver portion 200 of a firearm 50 (e.g., a firearm based on an AR platform such as an AR15-styled or AR10-styled rifle, carbine, pistol or shotgun), and the ambidextrous safety selector switch may be operable by a first finger 310 of a hand 300 of a user on a first side of receiver portion 200 and by a second finger 320 of the hand 300 of the user on a second side of receiver portion 200 opposite the first side thereof when installed on receiver portion 200. For instance, for a right-handed user who grips firearm 50 using his/her right hand, when installed on receiver portion 200 the ambidextrous safety selector switch may be operable by a first finger 310 (e.g., thumb) of the right hand 300 of the user on a first side (e.g., left side) of receiver portion 200 and by a second finger 320 (e.g., index finger) of the right hand 300 of the user on a second side (e.g., right side) of receiver portion 200 opposite the first side thereof.

Under a proposed design in accordance with the present disclosure, the ambidextrous safety selector switch may include a first safety selector 100A configured to be installed on the first side (e.g., left side) of receiver portion 200 and a second safety selector 100B configured to be installed on the second side (e.g., right side) of receiver portion 200. Device 100 may also include an axle 105 configured to connect to first safety selector 100A on one end and connect to second safety selector 1008 on an opposite end. Axle 105 may be configured with notch(es)/groove(s) and/or protrusion(s) (not shown) to interlockingly mate with corresponding protrusion(s) and/or notch(es)/groove(s) on first safety selector 100A and second safety selector 1008. Accordingly, when the ambidextrous safety selector switch is installed on firearm 50, when one of first safety selector 100A and second safety selector 1008 is pivoted or otherwise turned by a user, the other of first safety selector 100A and second safety selector 100B would also be pivoted or turned in the same (whether clockwise or counter-clockwise) direction.

Under a proposed design in accordance with the present disclosure, device 100 may include a non-ambidextrous safety selector switch, which may include either (but not both) first safety selector 100A or second safety selector 1008. In this design, device 100 may be installed on one side (e.g., left side or right side) of receiver portion 200 of firearm 50. Thus, although the examples shown in FIG. 1~FIG. 5 may show an ambidextrous safety selector switch with both first safety selector 100A and second safety selector 1008, the scope of the present disclosure also covers designs and implementations in which one, but not both, of first safety selector 100A and second safety selector 100B is installed on a firearm (e.g., firearm 50) to function as a safety selector switch.

Under the proposed design, the first safety selector 100A may include a first connection portion 108A and a first lever portion 102A. The first connection portion 108A may be configured to pivotably couple to receiver portion 200. The first lever portion 102A may have a first distal end (e.g., front end) and a second distal end (e.g., back end) extending away from the first connection portion 108A in two different directions. For instance, when installed on receiver portion 200 of firearm 50, the first distal end of the first lever portion 102A may extend generally toward a front end of firearm 50 from the first connection portion 108A and the second distal end of the first lever portion 102A may extend generally toward a back end of firearm 50 from the first connection portion 108A. Accordingly, when installed on the first side of receiver portion 200 of firearm 50: (1) the first safety selector 100A may be pivotable clockwise responsive to the user pressing or pushing either of the first distal end and the second distal end in one way (e.g., to turn the safety selector switch from a first mode to a second mode), and (2) the first safety selector 100A may be pivotable counter-clockwise responsive to the user pressing or pushing either of the first distal end and the second distal end in another way (e.g., to turn the safety selector switch from the second mode to the first mode).

Under the proposed design, the second safety selector 100B may include a second connection portion 108B and a second lever portion 102B. The second connection portion 1088 may be configured to pivotably couple to receiver portion 200. The second lever portion 1028 may have a first distal end (e.g., front end) and a second distal end (e.g., back end) extending away from the second connection portion in two different directions. For instance, when installed on receiver portion 200 of firearm 50, the first distal end of the second lever portion 1028 may extend generally toward a front end of firearm 50 from the first connection portion 1088 and the second distal end of the second lever portion 102B may extend generally toward a back end of firearm 50 from the first connection portion 108B. Accordingly, when installed on the second side of receiver portion 200 of firearm 50: (1) the second safety selector 100B may be pivotable clockwise responsive to the user pressing or pushing either of the first distal end and the second distal end in one way (e.g., to turn the safety selector switch from the first mode to the second mode), and (2) the second safety selector 1008 may be pivotable counter-clockwise responsive to the user pressing or pushing either of the first distal end and the second distal end in another way (e.g., to turn the safety selector switch from the second mode to the first mode).

Under a proposed design in accordance with the present disclosure, a first length (denoted as $L_1$ in FIG. 1) between a tip of the first distal end of the first lever portion 102A (e.g., front tip) and a center of the first connection portion 108A may be greater than a second length (denoted as $L_2$ in FIG. 1) between a tip of the second distal end of the first lever portion 102A (e.g., back tip) and the center of the first connection portion 108A. Alternatively, or additionally, a first length (denoted as $L_1$ in FIG. 1) between a tip of the first distal end of the second lever portion 1028 (e.g., front tip) and a center of the second connection portion 108B may be greater than a second length (denoted as $L_2$ in FIG. 1) between a tip of the second distal end of the second lever portion 1028 (e.g., back tip) and the center of the second connection portion 1088.

Under a proposed design in accordance with the present disclosure, the first lever portion 102A may include a first pedal at the first distal end (e.g., front end), and the first lever portion 102A may also include a second pedal at the second distal end (e.g., back end). In some implementations, at least a surface (e.g., top surface and/or bottom surface) of the first pedal may be textured, and at least a surface (e.g., top surface and/or bottom surface) of the second pedal may be textured. Additionally, an angle θ° between a plane defined by a surface (e.g., top surface shown in FIG. 1) of the first pedal and a longitudinal axis 101A of the first lever portion 102A may be greater than zero (e.g., between 1° and 45°).

Under a proposed design in accordance with the present disclosure, the second lever portion 102B may include a first pedal at the first distal end (e.g., front end), and the second lever portion 1028 may also include a second pedal at the second distal end (e.g., back end). In some implementations, at least a surface (e.g., top surface and/or bottom surface) of the first pedal may be textured, and at least a surface (e.g., top surface and/or bottom surface) of the second pedal may be textured. Additionally, an angle θ° between a plane defined by a surface of the first pedal and a longitudinal axis 101B of the second lever portion 102B may be greater than zero (e.g., between 1° and 45°).

Figure 2:
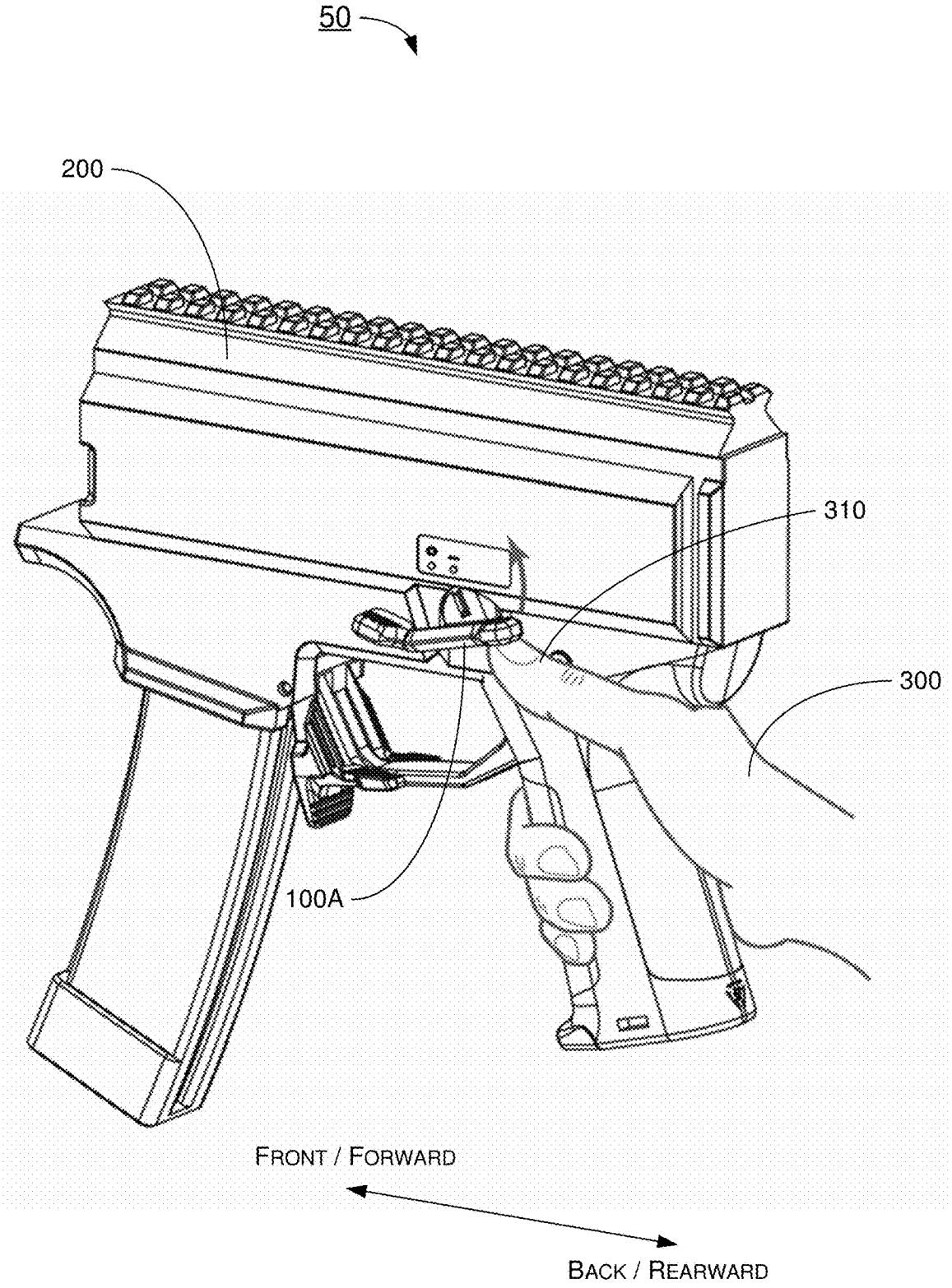
FIG. 2 is a diagram of an example scenario in accordance with an implementation of the present disclosure.

FIG. 2 illustrates an example scenario 200 in accordance with an implementation of the present disclosure. In scenario 200, firearm 50 is gripped by a right hand 300 of a user. Accordingly, the user may pivot or turn the ambidextrous safety selector switch in one way (e.g., counter-clockwise when looking at the left side of receiver portion 200 as shown in FIG. 2) by using his/her thumb 310 to push upward the second pedal on the second distal end (e.g., back end) of first safety selector 100A.

Figure 3:
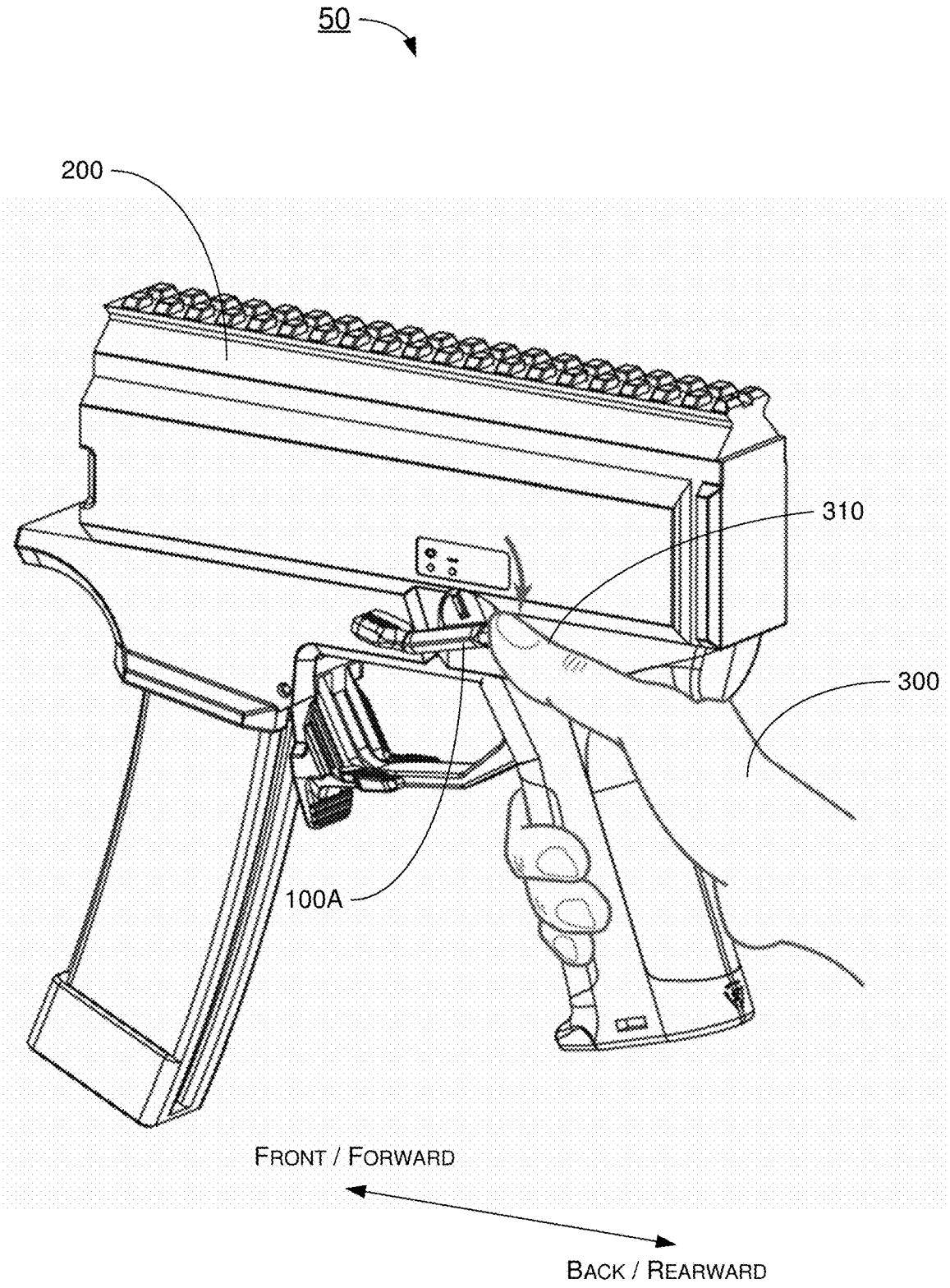
FIG. 3 is a diagram of an example scenario in accordance with an implementation of the present disclosure.

FIG. 3 illustrates an example scenario 300 in accordance with an implementation of the present disclosure. In scenario 300, firearm 50 is gripped by the right hand 300 of the user. Accordingly, the user may pivot or turn the ambidextrous safety selector switch in another way (e.g., clockwise when looking at the left side of receiver portion 200 as shown in FIG. 3) by using his/her thumb 310 to push downward the second pedal on the second distal end (e.g., back end) of first safety selector 100A.

Figure 4:
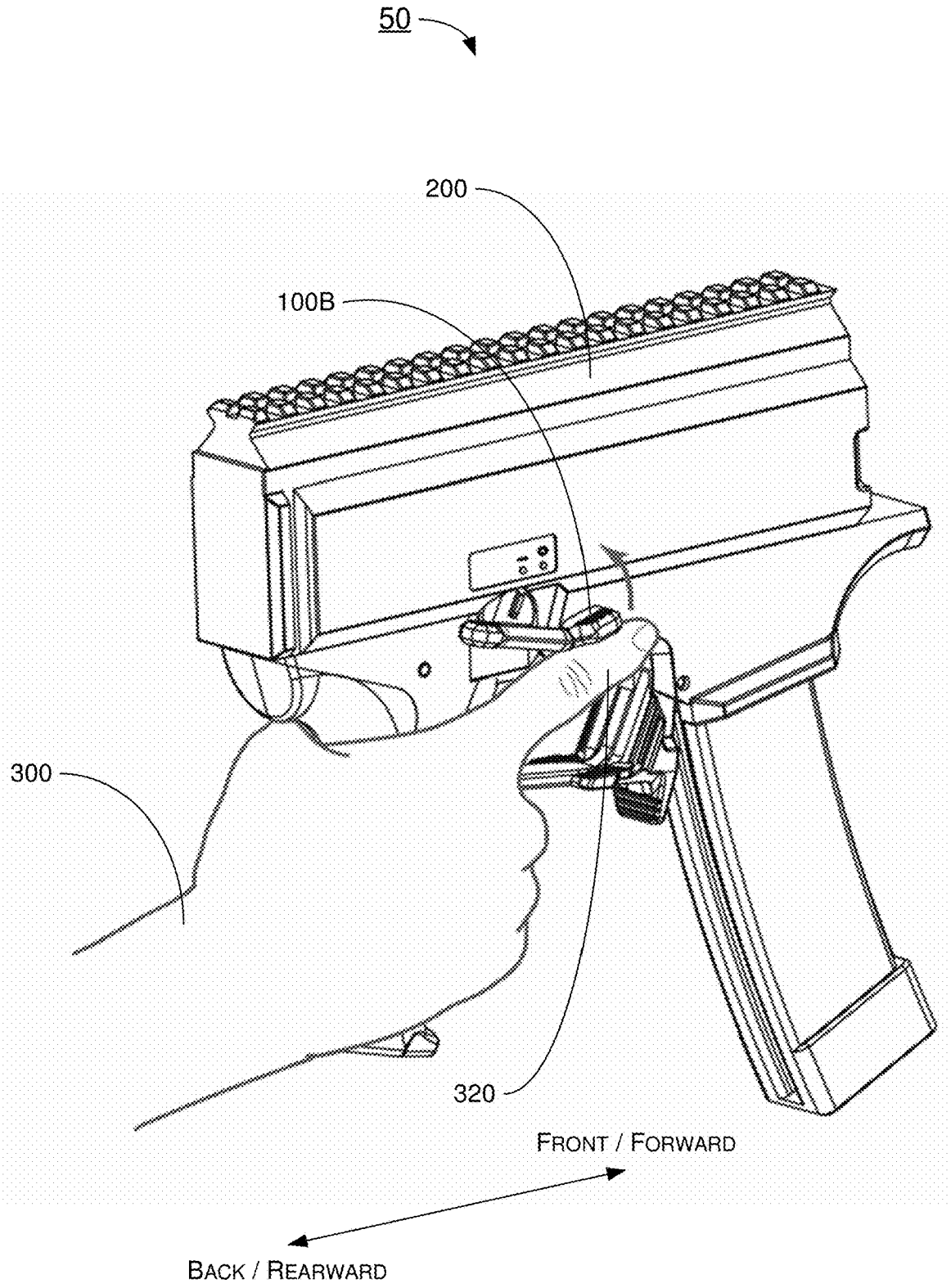
FIG. 4 is a diagram of an example scenario in accordance with an implementation of the present disclosure.

FIG. 4 illustrates an example scenario 400 in accordance with an implementation of the present disclosure. In scenario 400, firearm 50 is gripped by the right hand 300 of the user. Accordingly, the user may pivot or turn the ambidextrous safety selector switch in one way (e.g., counter-clockwise when looking at the right side of receiver portion 200 as shown in FIG. 4) by using his/her index finger 320 to push upward the first pedal on the first distal end (e.g., front end) of second safety selector 100B.

Figure 5:
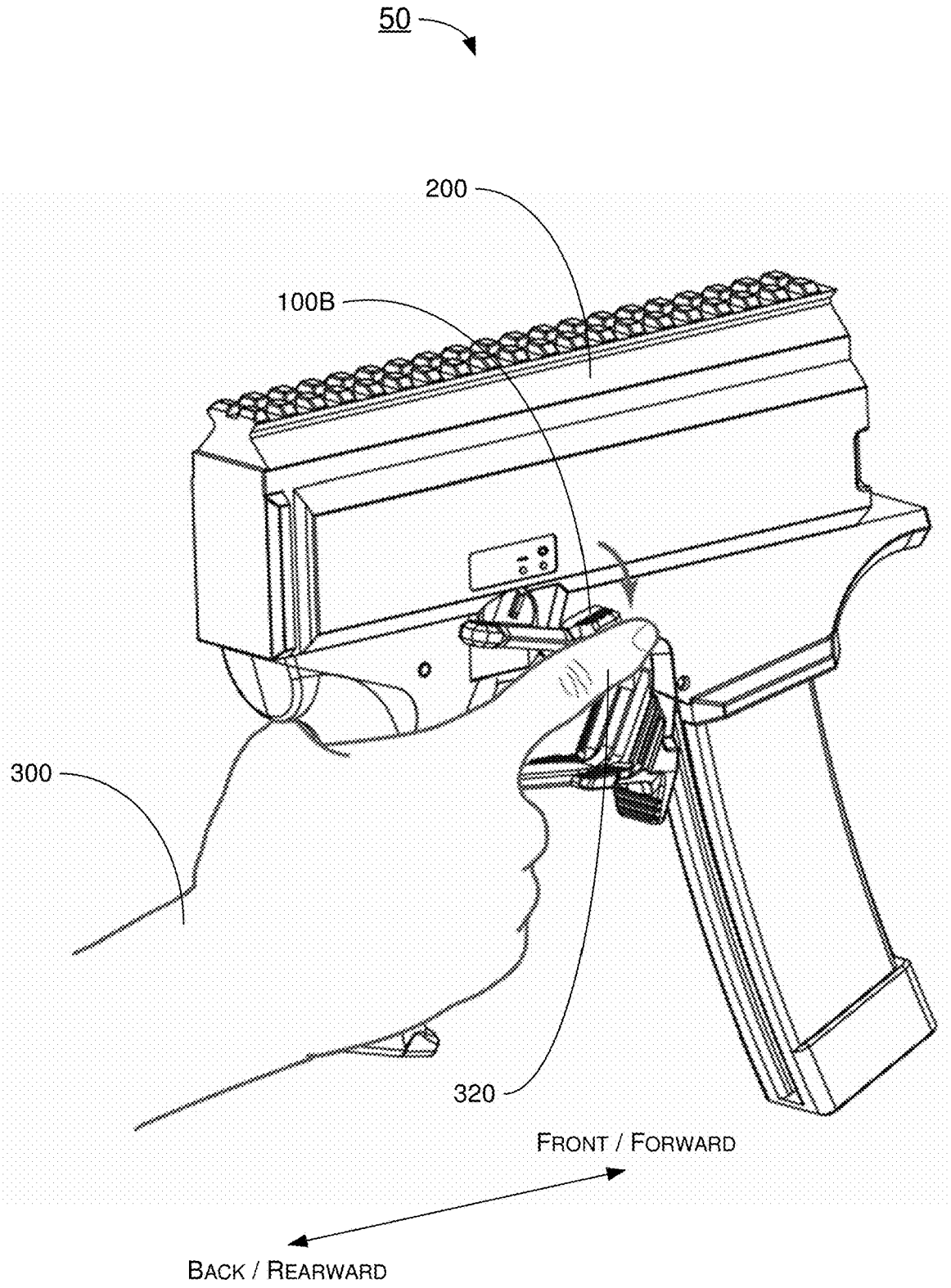
FIG. 5 is a diagram of an example scenario in accordance with an implementation of the present disclosure.

FIG. 5 illustrates an example scenario 500 in accordance with an implementation of the present disclosure. In scenario 500, firearm 50 is gripped by the right hand 300 of the user. Accordingly, the user may pivot or turn the ambidextrous safety selector switch in another way (e.g., clockwise when looking at the right side of receiver portion 200 as shown in FIG. 5) by using his/her index finger 320 to push downward the first pedal on the first distal end (e.g., front end) of second safety selector 100B.

It is noteworthy that, although it is a right hand in the examples shown in FIG. 2~FIG. 5, a device in accordance with the present disclosure, whether ambidextrous (e.g., with first and second safety selectors 100A/100B installed on both sides of receiver portion 50) or non-ambidextrous (e.g., with either of first and second safety selectors 100A/100B installed on one side of receiver portion 50), may still be functional or otherwise operational with a left hand. That is, all the description and examples in the present disclosure pertaining to right-handed usage may also apply to left-handed usage. For instance, in FIG. 2 and FIG. 3, device 100 may include first safety selector 100A (but not second safety selector 100B) with first safety selector 100A installed on the left side of receiver portion 200, and first safety selector 100A may be operated by the thumb 310 of the user. Similarly, in FIG. 4 and FIG. 5, device 100 may include second safety selector 100B (but not first safety selector 100A) with second safety selector 100B installed on the right side of receiver portion 200, and second safety selector 100B may be operated by the index finger 320 of the user.

It is also noteworthy that the dimensions of various components of the proposed design may be adjusted to suit actual implementations. For instance, the overall size may be enlarged for implementation on a firearm of the AR10 platform (e.g., one chambered in 308 Winchester or 7.62×51 mm NATO). Similarly, the overall style may be changed. Likewise, the overall size may be reduced for implementation on a firearm of the AR15 platform (e.g., one chambered in .223 Remington or 5.56×54 mm NATO). For instance, dust cover housing 150 may be replaced with one that has a same angled surface but has no cavity to receive dust cover 40. It is also noteworthy that, with suitable adjustment to one or more components, device 100 may be made suitable to serve as a bolt charging handle as an alternative or additional use/function. It is further noteworthy that each component of device 100 may be made of a suitable material (e.g., a suitable metal such as steel, aluminum or alloy) with appropriate mechanical properties such as sufficient strengths and/or hardness to withstand vibrations caused by firing of ammunition cartridges.

It is further noteworthy that term "AR platform" herein refers to firearms based on the AR15 platform and the AR10 platform, as well as any variation and derivative thereof, and include AR15-styled and AR10-styled firearms, including rifles, carbines, pistols and shotguns. A firearm based on an AR platform may be chambered in one of a plethora of calibers. Some of the more popular calibers include such as, for example and without limitation, .223 Remington, 5.56×54 mm NATO, .224 Valkyrie, 300 AAC Blackout, 7.62×39 mm, 458 SOCOM, 6.5 mm Grendel, 6.8 mm Remington SPC, 308 Winchester and 7.62×51 mm NATO, just to name a few. Accordingly, the proposed design in accordance with the present disclosure may be implemented in any firearm based on the AR platform (whether the AR15 platform or the AR10 platform), as well as any variation and derivative thereof, in any suitable caliber.

Example Implementations

In view of the above, the proposed designs of a dual-finger operable safety selector for firearms may be implemented in many ways. For illustrative purposes and without limiting the scope of the present disclosure, a few example implementations of the proposed design are described below.

In one aspect, a device implementable on a firearm (e.g., a firearm based on an AR platform such as an AR15-styled or AR10-styled rifle, carbine, pistol or shotgun) may include an ambidextrous safety selector switch. The ambidextrous safety selector switch may be configured to be installed on a receiver portion of the firearm and operable by a first finger of a hand of a user on a first side of the receiver portion and by a second finger of the hand of the user on a second side of the receiver portion opposite the first side thereof when installed on the receiver portion.

In some implementations, the ambidextrous safety selector switch may include a first safety selector configured to be installed on the first side of the receiver portion and a second safety selector configured to be installed on the second side of the receiver portion. The first safety selector may include a first connection portion and a first lever portion. The first connection portion may be configured to pivotably couple to the receiver portion. The first lever portion may have a first distal end and a second distal end extending away from the first connection portion in two different directions. Accordingly, when installed on the first side of the receiver portion of the firearm: (1) the first safety selector may be pivotable clockwise responsive to the user pressing or pushing either of the first distal end and the second distal end in one way, and (2) the first safety selector may be pivotable counter-clockwise responsive to the user pressing or pushing either of the first distal end and the second distal end in another way. The second safety selector may include a second connection portion and a second lever portion. The second connection portion may be configured to pivotably couple to the receiver portion. The second lever portion may have a first distal end and a second distal end extending away from the second connection portion in two different directions. Accordingly, when installed on the second side of the receiver portion of the firearm: (1) the second safety selector may be pivotable clockwise responsive to the user pressing or pushing either of the first distal end and the second distal end in one way, and (2) the second safety selector may be pivotable counter-clockwise responsive to the user pressing or pushing either of the first distal end and the second distal end in another way.

In some implementations, a first length between a tip of the first distal end of the first lever portion and a center of the first connection portion may be greater than a second length between a tip of the second distal end of the first lever portion and the center of the first connection portion.

In some implementations, when installed on the receiver portion of the firearm, the first distal end of the first lever portion may extend generally toward a front end of the firearm from the first connection portion and the second distal end of the first lever portion may extend generally toward a back end of the firearm from the first connection portion.

In some implementations, a first length between a tip of the first distal end of the second lever portion and a center of the second connection portion may be greater than a second length between a tip of the second distal end of the second lever portion and the center of the second connection portion.

In some implementations, when installed on the receiver portion of the firearm, the first distal end of the second lever portion may extend generally toward a front end of the firearm from the first connection portion and the second distal end of the second lever portion may extend generally toward a back end of the firearm from the first connection portion.

In some implementations, the first lever portion may include a first pedal at the first distal end, and the first lever portion may also include a second pedal at the second distal end. In some implementations, a surface of the first pedal may be textured, and a surface of the second pedal may be textured. In some implementations, an angle between a plane defined by a surface of the first pedal and a longitudinal axis of the first lever portion may be greater than zero.

In some implementations, the second lever portion may include a first pedal at the first distal end, and the second lever portion may also include a second pedal at the second distal end. In some implementations, a surface of the first pedal may be textured, and a surface of the second pedal may be textured. In some implementations, an angle between a plane defined by a surface of the first pedal and a longitudinal axis of the second lever portion may be greater than zero.

In another aspect, a device implementable on a firearm (e.g., a firearm based on an AR platform such as an AR15-styled or AR10-styled rifle, carbine, pistol or shotgun) may include a first safety selector configured to be installed on a receiver portion of the firearm. The first safety selector may include a first connection portion and a first lever portion. The first connection portion may be configured to pivotably couple to the receiver portion. The first lever portion may have a first distal end and a second distal end extending away from the first connection portion in two different directions. Accordingly, when installed on the receiver portion of the firearm: (1) the first safety selector may be pivotable clockwise responsive to a user pressing or pushing either of the first distal end and the second distal end in one way, and (2) the first safety selector may be pivotable counter-clockwise responsive to the user pressing or pushing either of the first distal end and the second distal end in another way.

In some implementations, a first length between a tip of the first distal end of the first lever portion and a center of the first connection portion may be greater than a second length between a tip of the second distal end of the first lever portion and the center of the first connection portion.

In some implementations, when installed on the receiver portion of the firearm, the first distal end of the first lever portion may extend generally toward a front end of the firearm from the first connection portion and the second distal end of the first lever portion may extend generally toward a back end of the firearm from the first connection portion.

In some implementations, the first lever portion may include a first pedal at the first distal end, and the first lever portion may also include a second pedal at the second distal end. In some implementations, a surface of the first pedal may be textured, and a surface of the second pedal may be textured. In some implementations, an angle between a plane defined by a surface of the first pedal and a longitudinal axis of the first lever portion may be greater than zero.

In some implementations, the device may further include a second safety selector configured to be installed on the receiver portion of the firearm. The second safety selector may include a second connection portion and a second lever portion. The second connection portion may be configured to pivotably couple to the receiver portion. The second lever portion may have a first distal end and a second distal end extending away from the second connection portion in two different directions. Accordingly, when installed on the receiver portion of the firearm: (1) the second safety selector may be pivotable clockwise responsive to the user pressing or pushing either of the first distal end and the second distal end in one way, and (2) the second safety selector may be pivotable counter-clockwise responsive to the user pressing or pushing either of the first distal end and the second distal end in another way. In some implementations, the first safety selector may be installed on a first side of the receiver portion and the second safety selector may be installed on a second side of the receiver portion opposite the first side.

In some implementations, a first length between a tip of the first distal end of the second lever portion and a center of the second connection portion may be greater than a second length between a tip of the second distal end of the second lever portion and the center of the second connection portion.

In some implementations, when installed on the receiver portion of the firearm, the first distal end of the second lever portion may extend generally toward a front end of the firearm from the second connection portion and the second distal end of the second lever portion may extend generally toward a back end of the firearm from the second connection portion.

In some implementations, the second lever portion may include a first pedal at the first distal end, and the second lever portion may also include a second pedal at the second distal end. In some implementations, a surface of the first pedal may be textured, and a surface of the second pedal may be textured. In some implementations, an angle between a plane defined by a surface of the first pedal and a longitudinal axis of the second lever portion may be greater than zero.

ADDITIONAL NOTES

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

an ambidextrous safety selector switch configured to be installed on a receiver portion of the firearm and operable by a first finger of a hand of a user on a first side of the receiver portion and by a second finger of the hand of the user on a second side of the receiver portion opposite the first side thereof when installed on the receiver portion, wherein the ambidextrous safety selector switch comprises a first safety selector configured to be installed on the first side of the receiver portion and a second safety selector configured to be installed on the second side of the receiver portion, wherein the first safety selector comprises:

a first connection portion configured to pivotably couple to the receiver portion; and a first lever portion having a first distal end and a second distal end extending away from the first connection portion in two different directions, wherein, when installed on the first side of the receiver portion of the firearm:

the first safety selector is pivotable clockwise responsive to the user pressing or pushing either of the first distal end and the second distal end in one way, and the first safety selector is pivotable counter-clockwise responsive to the user pressing or pushing either of the first distal end and the second distal end in another way, wherein the second safety selector comprises:

a second connection portion configured to pivotably couple to the receiver portion; and a second lever portion having a first distal end and a second distal end extending away from the second connection portion in two different directions, wherein, when installed on the second side of the receiver portion of the firearm:

the second safety selector is pivotable clockwise responsive to the user pressing or pushing either of the first distal end and the second distal end in one way, and the second safety selector is pivotable counter-clockwise responsive to the user pressing or pushing either of the first distal end and the second distal end in another way, wherein the first lever portion comprises a first pedal at the first distal end, wherein the first lever portion further comprises a second pedal at the second distal end, wherein a surface of the first pedal is textured, wherein a surface of the second pedal is textured, and wherein an angle between a plane defined by a surface of the first pedal and a longitudinal axis of the first lever portion is greater than zero.

2. The device of claim 1, wherein a first length between a tip of the first distal end of the first lever portion and a center of the first connection portion is greater than a second length between a tip of the second distal end of the first lever portion and the center of the first connection portion.

3. The device of claim 2, wherein, when installed on the receiver portion of the firearm, the first distal end of the first lever portion extends generally toward a front end of the firearm from the first connection portion and the second distal end of the first lever portion extends generally toward a back end of the firearm from the first connection portion.

4. The device of claim 1, wherein a first length between a tip of the first distal end of the second lever portion and a center of the second connection portion is greater than a second length between a tip of the second distal end of the second lever portion and the center of the second connection portion.

5. The device of claim 4, wherein, when installed on the receiver portion of the firearm, the first distal end of the second lever portion extends generally toward a front end of the firearm from the first connection portion and the second distal end of the second lever portion extends generally toward a back end of the firearm from the first connection portion.

6. The device of claim 1, wherein the second lever portion comprises a first pedal at the first distal end, wherein the second lever portion further comprises a second pedal at the second distal end, wherein a surface of the first pedal is textured, and wherein a surface of the second pedal is textured, and wherein an angle between a plane defined by a surface of the first pedal and a longitudinal axis of the second lever portion is greater than zero.

7. A device implementable on a firearm, comprising:

a first safety selector configured to be installed on a receiver portion of the firearm, comprising:

a first connection portion configured to pivotably couple to the receiver portion; and a first lever portion having a first distal end and a second distal end extending away from the first connection portion in two different directions, wherein, when installed on the receiver portion of the firearm:

the first safety selector is pivotable clockwise responsive to a user pressing or pushing either of the first distal end and the second distal end in one way, and the first safety selector is pivotable counter-clockwise responsive to the user pressing or pushing either of the first distal end and the second distal end in another way, wherein a first length between a tip of the first distal end of the first lever portion and a center of the first connection portion is greater than a second length between a tip of the second distal end of the first lever portion and the center of the first connection portion, wherein, when installed on the receiver portion of the firearm, the first distal end of the first lever portion extends generally toward a front end of the firearm from the first connection portion and the second distal end of the first lever portion extends generally toward a back end of the firearm from the first connection portion, wherein the first lever portion comprises a first pedal at the first distal end, wherein the first lever portion further comprises a second pedal at the second distal end, wherein a surface of the first pedal is textured, and wherein a surface of the second pedal is textured.

8. The device of claim 7, wherein an angle between a plane defined by a surface of the first pedal and a longitudinal axis of the first lever portion is greater than zero.

9. The device of claim 7, further comprising:

a second safety selector configured to be installed on the receiver portion of the firearm, comprising:

a second connection portion configured to pivotably couple to the receiver portion; and a second lever portion having a first distal end and a second distal end extending away from the second connection portion in two different directions, wherein, when installed on the receiver portion of the firearm:

the second safety selector is pivotable clockwise responsive to the user pressing or pushing either of the first distal end and the second distal end in one way, and the second safety selector is pivotable counter-clockwise responsive to the user pressing or pushing either of the first distal end and the second distal end in another way, wherein the first safety selector is installed on a first side of the receiver portion and the second safety selector is installed on a second side of the receiver portion opposite the first side.

10. The device of claim 9, wherein a first length between a tip of the first distal end of the second lever portion and a center of the second connection portion is greater than a second length between a tip of the second distal end of the second lever portion and the center of the second connection portion.

11. The device of claim 10, wherein, when installed on the receiver portion of the firearm, the first distal end of the second lever portion extends generally toward a front end of the firearm from the second connection portion and the second distal end of the second lever portion extends generally toward a back end of the firearm from the second connection portion.

12. The device of claim 11, wherein the second lever portion comprises a first pedal at the first distal end, and wherein the second lever portion further comprises a second pedal at the second distal end.

13. The device of claim 12, wherein a surface of the first pedal is textured, and wherein a surface of the second pedal is textured.

14. The device of claim 12, wherein an angle between a plane defined by a surface of the first pedal and a longitudinal axis of the second lever portion is greater than zero.

* * * * *